United States Patent [19]

Sappington

[11] Patent Number: 4,801,278

[45] Date of Patent: Jan. 31, 1989

[54] LOW PROFILE BREAK-AWAY FUSEBLOCK

[75] Inventor: Gayle L. Sappington, Glendale, Mo.

[73] Assignee: Cooper Inductries, Inc., Houston, Tex.

[21] Appl. No.: 632,051

[22] Filed: Jul. 18, 1984

[51] Int. Cl.[4] ..... H01R 13/432

[52] U.S. Cl. ..... 439/746; 439/830

[58] Field of Search ..... 339/59 M, 219 S, 258 F; 439/595, 746–749, 830–833; 29/842

[56] References Cited

U.S. PATENT DOCUMENTS

| | | | |
|---|---|---|---|
| 4,391,482 | 7/1983 | Czeschka | 339/59 M |
| 4,423,916 | 1/1984 | Muehlhausen, II | 339/59 M |
| 4,432,594 | 2/1984 | Daggett | 339/258 F |
| 4,473,268 | 9/1984 | Watanabe | 339/258 F |

FOREIGN PATENT DOCUMENTS

| | | | |
|---|---|---|---|
| 2058870 | 6/1972 | Fed. Rep. of Germany | 339/258 F |
| 2091049 | 7/1982 | Fed. Rep. of Germany | 339/217 S |

*Primary Examiner*—Gary F. Paumen

*Attorney, Agent, or Firm*—Nelson A. Blish; Eddie E. Scott; Alan Thiele

[57] ABSTRACT

A fuse holder for a cylindrical fuse with a tubular body and conductive metal end caps is disclosed where the holder includes a molded base and metal terminals. The base is adapted to carry a pair of terminals in spaced apart alignment to receive at least one fuse, but a plurality of fuses can be carried in parallel rows on a common base between aligned pairs of terminals. Notched lines are positioned between the rows to define lines of weakness for severance of the molded base providing at least one fuse holder and terminal pair. The configuration of one fuse holder is elongated and rectangular with the molded base having a generally flat center and raised ends. The terminals are identical in shape and snap fit to the ends of the base between a pair of upstanding legs which form a channel for alignment with the axis of the fuse. Each terminal has a squat U shape in end profile and includes four spring fingers to hold the fuse end cap against the terminal base which is the flat bottom part of the U. A lug extends from the terminal outwardly of the base to accept connection to a circuit. The terminals rest in the channels upon raised bottom areas, whereby the body of the fuse is carried fully seated in the terminals, yet above the flat center of the base.

27 Claims, 1 Drawing Sheet

LOW PROFILE BREAK-AWAY FUSEBLOCK

BACKGROUND OF THE DISCLOSURE

This disclosure relates to fuse holders of the type made for holding cylindrical replaceable fuses with a diameter of $\frac{1}{4}$ inch and a tubular length of $1\frac{1}{4}$ inches. These fuses have metal cup shaped end caps with their open ends facing and connected therebetween by a fusible link. A hollow tube of glass or other insulating material is disposed to separate and support the metal cup shaped ends in alignment with each other and to protect the fusible link which passes therethrough. The fuse holders for such fuses generally include terminals which engage the cup shaped fuse ends thereby to electrically connect the fusible link in series with the circuit to be protected. The connection terminals are normally configured to resiliently engage the metal cup shaped ends and hold them for electrical connection and ease of fuse replacement. Such fuse holders are often located such that the insulating glass tube allows visual examination of the connection of the fusible link whereby electrical continuity of the fuse can be determined.

Generally, the fuse holder also has an insulative support base to position the resilient terminals apart and in-line with one another to receive the fuse end caps of a cylindrical fuse and to support the glass insulating tube between the terminals. Such fuse support bases can be a molded polymeric insulating material having a high dielectric and the molded base can include mounting provisions for attaching the terminals to the base. Moreover, the support base can be arranged to carry a plurality of terminals to locate a number of fuses side by side in parallel spaced relation to one another. The fuse support base could also include an area for severance so that a plurality of parallel fuse holders can be split apart to form individual fuse holders or any selected number of fuse holders on a common support base. Consequently, a preferred number of fuse holders can be obtained from a strip containing a large number of holders by cutting the base at selected areas. Prior art arrangements are often wasteful of material and difficult to use, and may also be difficult to manufacture and assemble.

The fuse holders of the type described may suffer from problems associated with the fact that the cylindrical fuses described are generally for relatively low voltage circuits used in severe environments, such as equipment subject to vibration. Therefore, an excellent contact terminal design is required to facilitate good physical and electrical connection between fuse and terminal. The resilient terminals normally used are spring type of electrically conducting metal material configured to receive and hold the cup shaped metal cap ends, while maintaining electrical contact. The most common terminal configuration is U-shaped to circumscribe a part of the circular end cap of the fuse and is specifically arranged to conjugate with the circular cross sectional shape of the end cap, except at its open side, i.e., the mouth of the U-shaped terminal. In addition, the terminals have connection lugs to receive solder or solderless terminals, or threaded fasteners or the like to ease its electrical connection with a circuit.

There are terminals designed to cooperate during assembly with the specially configured portions of an insulative support base, but the generally inflexible support base material hampers effective and secure assembly. None of the prior designs manage completely to securely position the terminal on the fuse support base and resist movement and defy fatigue associated with use in a vibration prone environment. Little has been done to assure both good terminal contact and ease of terminal positioning on the support base. In particular, the forces applied during insertion and removal of the fuse from the terminals or applied during connection to the circuit with solderless terminals, threaded fasteners or the like must be resisted by the terminal mounting to its support base and the base attachment to its support chassis. In particular, the design of the support base must be such as to accurately secure the terminal and thereby assist in the operation of receiving and holding the fuse in position. Notwithstanding the foregoing requirements, fuse replacement must be easily performed.

In order to overcome the deficiencies of the available fuse holders and provide an improved arrangement with advantages and features heretofore unknown and unappreciated, it is an object of this disclosure to set forth an improved and easy to use fuse holder.

It is another object of the invention disclosed to teach a low cost fuse holder capable of reliable operation and securely supporting fuses for excellent electrical connection in a circuit.

It is a further object of the invention disclosed to have a design for a terminal clip which is securely mounted to its base by an easy low cost manner of assembly whereby the terminal mounting will resist movement between base and clip.

It is yet a further object of the invention illustrated herein to show an easily severable support base design which allows the common fuse support base for a plurality of fuses to be readily and cleanly separated into individual fuse holders or fuse holder sets.

BRIEF SUMMARY OF THE INVENTION

In order to satisfy the stated objects of providing an improved fuse holder, there are components consisting of a molded insulative support base and at least a pair of conductive metal resilient terminals. Each of the terminals is of the same configuration and is adapted to snap fit into an end of the support base. The support base has a generally flat central section of elongated rectangular shape with a mounting hole at its center. At each end of the support base, there are spaced apart pairs of upstanding legs which define a U-shaped channel. The open portion of the channel between the legs provides a place to receive a fuse terminal clip. The bottom of the channel between the legs is an area raised above the central section of the support base.

The terminals each have a fuse receiving spring clip which is generally of a squat hairpin shape, as seen in the end profile of FIG. 3. Each terminal sits within an end channel upon the raised bottom area with its open end facing upwardly away from the supporting base and in position to receive a cylindrical fuse end cap. The bottom curve of the clip is at its base and spring fingers extend upwardly from the base. Each terminal has a connector lug extending from the clip base outwardly away from the center of the support. The connector lug can be shaped to form a spade as a solder terminal or for cooperation with a solder or solderless terminal or may include a may include a threaded fastener to secure a wire or terminal. The spring clip particularly includes a base and four upstanding spring fingers, two pairs of fingers opposite each other on each side of the support base. The four spring fingers of the clip are designed to form a place to receive the cup shaped metal end caps of a tubular fuse. Each spring finger is bent slightly toward the other positioned opposite thereto and each extends upwardly away from the base to an inwardmost point. The points on opposite fingers which are closest together (across the fuse end caps) are positioned at least more than one-half the diameter of the fuse end cap from the base. That is to say that, the inwardly curved portion is greater in height than the radius of the fuse end cap. From the inwardmost point of the bent spring finger, it extends upwardly further, but it is bent backwardly to present a more outwardly open upper area to first receive the fuse during insertion. During insertion the metal fuse end cap cams remove the upper backwardly bent portion of the spring fingers to spread the inwardmost points of the inwardly bent spring fingers. Further insertion results in the four terminal clip fingers receiving the fuse end cap and holding it tightly against the base portion of the terminal, whereby excellent electrical connection is achieved.

A recess centered on the inside wall of each support base leg is set to receive a part from the terminal clip. Between the upstanding spring fingers on each side of the terminal clip base there is an outwardly extending angled prong fashioned from the same spring metal as the terminal clip. Each prong is disposed to snap into and engage the centered recess in the inside wall of each leg of the support base, thereby maintaining the terminal spring clip within the support base inside the channel thereof formed by the legs. Similarly, the raised bottom areas of the channel beneath the terminal clip has a centered opening therethrough positioned to mate in male/female fashion with an extruded hole punched outwardly and downwardly from the base portion of the terminal clip. Vertical movement is prevented by the prongs and recesses and horizontal movement is controlled by the fit of the extruded hole in the base of the terminal clip with the opening in the raised bottom area of the support base.

On each terminal spring clip there are four upstanding fingers forming two sets of opposed fuse contacting and holding pairs. Each pair is identical and opposite. The pair nearest the end of the support base (nearest the connector lug) includes ears bent inwardly to control the axial position of the cylindrical fuse. These ears are bent normal to the inwardly bent spring fingers and are about halfway up the fingers so that ear contact is made approximately with the center horizontal diameter of a retained fuse end cap. The ears also position the fuse such that the fuse end caps always contact the four spring fingers of each terminal.

The central section of the support base between the upstanding legs contains a mounting hole for the fuse holder. The vertical height of the central section is kept to a minimum. Consequently, there is not only material savings, but this permits ready access to the glass insulator portion of the tubular fuse for removal by means of tools or by hand. In particular, the positions of the terminal clip bases on the raised areas of the support base place the fuse at a higher elevation than the lower central section of the support base. That placement permits the fuse glass insulator to be readily accessible to the jaws of a fuse pulling tool.

Extending laterally outward of the central section of the support base is a notched web molded as a part of the support base. The notched web is designed to extend the entire elongated length of the rectangular base even adjacent the leg portions. Notched webs extending laterally between the sides of elongated fuse support bases to connect a plurality of fuse support bases in parallel in side by side fashion remove form remove parallel spaced rows of fuse holders. A pair of parallel notches extends throughout the length of the web and are placed opposite each other at the boundary between the web and support bases. The opposed pair define a line of weakness along the base where the thin residual material between the pair of notches permits a severance or break to take place. The break is obtained by bending or stressing this residual material. The residual material is sufficiently thin and fragile to allow a clean separation along the line of weakness. In a preferred commercial embodiment, each pair of notches is positioned next to the side of the base of one of the fuse holders, whereby there is a body of web between the fuse holders and consequently, fracturing may take place along two lines of weakness severing the fuse holders and leaving the body of web as scrap.

The four terminal clip fingers cooperate with the base portion of the terminal clip to provide a low profile five contact point fuse clip. The vertical force required to hold the fuse end cap securely within the terminal clip is minimized by the four finger design and the slightly above horizontal center line location of their contact with the fuse end cap. The lessening of force to insert and remove the fuse is an important improvement of this design, as high insertion or removal forces could cause severance of the fuse holder from an adjoining fuse holder. This is consistent with the advantage of the notched web and the snap engagement assembly of the terminal clip.

Other objects, advantages and features of the invention will become apparent upon making reference to the detailed description, the drawings and the claims.

DETAILED DESCRIPTION OF THE DRAWINGS

Figure 1:
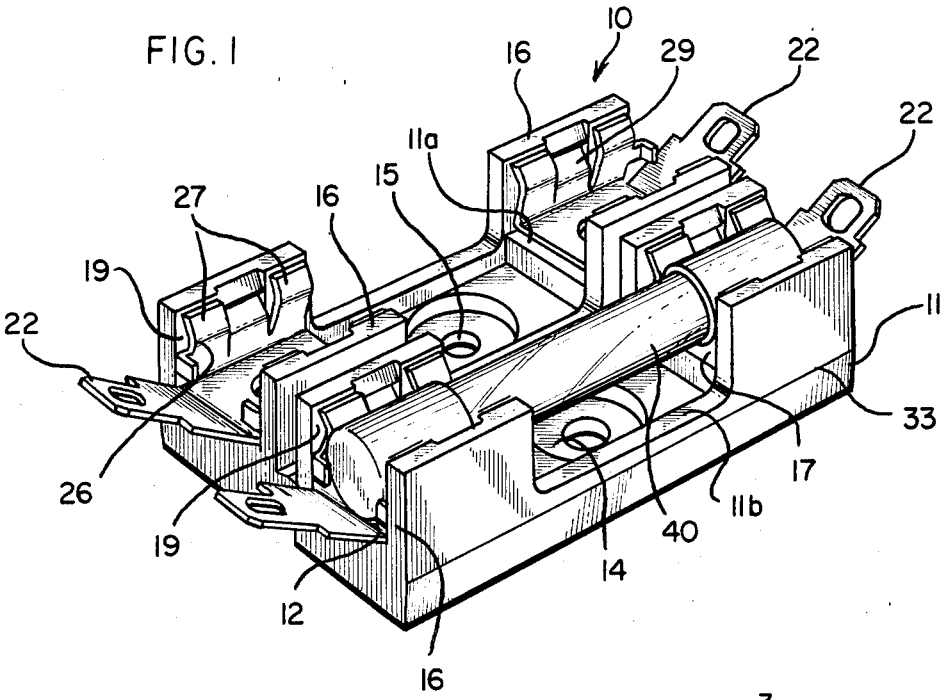
FIG. 1 is a perspective view of a plurality of fuse holders showing a fuse, in lighter phantom lines, inserted into the first of the fuse holders.
Figure 2:
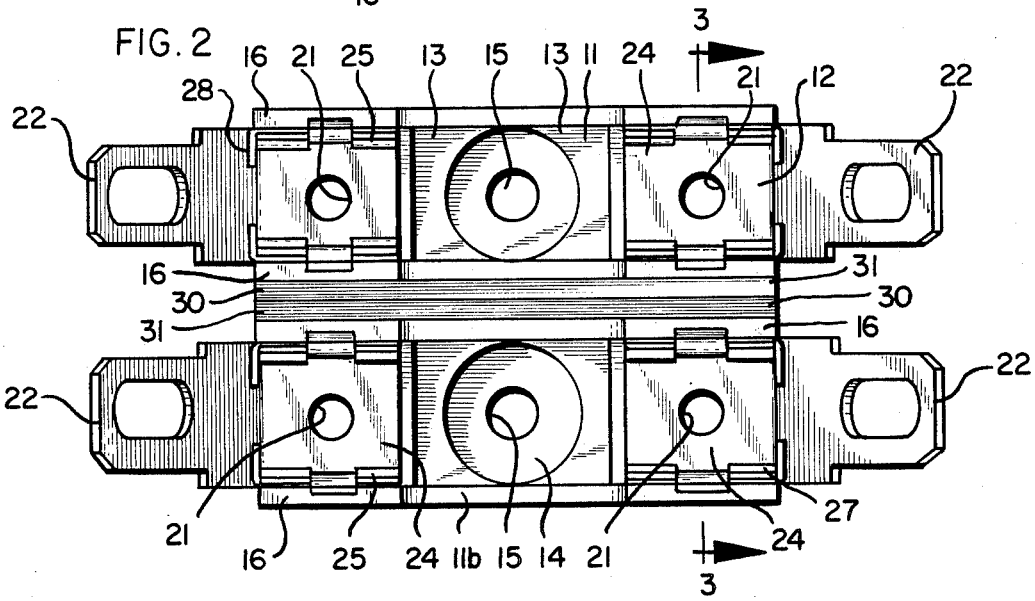
FIG. 2 is a top plan view of the fuse holders of FIG. 1 having a more complete showing of the details thereof, and in particular the way the terminal clips are aligned relative to one another to receive the tubular fuse, and in addition the location of the laterally extending notched web between adjacent fuse holder support bases.
Figure 3:
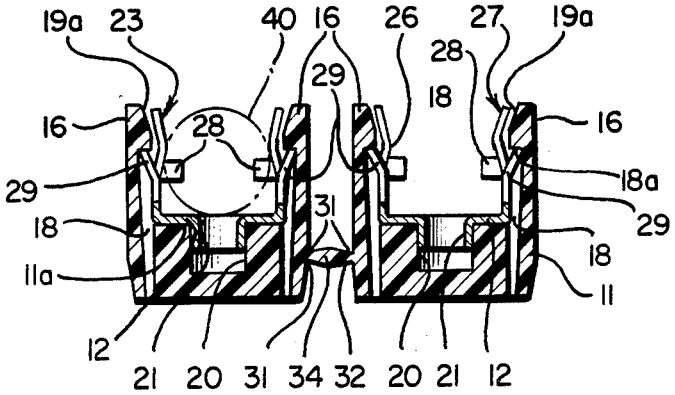
FIG. 3 is a cross sectional view taken along line 3—3 of FIG. 2 to illustrate the snap engagement assembly feature of the hairpin shaped terminal clip to the support base and the relationship between the clip and a fuse end cap which is shown as a circle.

For complete understanding of the invention, reference is made to a preferred embodiment of a fuse holder 10 as disclosed in the drawings. In particular in FIG. 1, a perspective view of fuse holder 10 with a tubular fuse is illustrated. Improved fuse holder 10 includes key components consisting of an insulative support base 11 and a pair of identical conductive metal terminals 12. Each of the terminals 12 is of the same configuration and opposite one another in facing aligned relation to resiliently receive a fuse 40. Each terminal 12 is adapted to snap fit securely into an end of the support base 11, as seen in FIGS. 2 and 3. In one preferred embodiment, the support base 11 is molded from a glass-filled polyester thermoplastic polymer and has a generally flat central section 13 of an elongated rectangular shape. A counter bored recess 14 for a mounting hole 15 is centered in central section 13, whereby a fastener can be used to hold support base 11 in position upon a chassis or flat surface (not shown). The head of the fastener can thereby sit within the counter bored recess 14 and remain flush with or below the surface of the central section 13.

Upstanding legs 16 are positioned at the ends of base 11 to form a channel 17 at each end thereof. Each channel 17 receives one terminal 12 and aligns it to hold an end of tubular fuse 40. Legs 16 are located on opposite sides of support base 11 adjacent to its ends and define a raised bottom **11*a* for the aforesaid channel 17. Channel 17 is in line with the fuse axis. Consequently, at each end of flat central section 13, the spaced apart pair of upstanding legs 16 which define channel 17, nest the terminal caps of fuse 40 in terminals 12 of fuse holder 10, as see FIG. 1, 2 and 3. When fuse 40 is aligned and held in the terminals 12, which rests on raised bottom 11*a*, the glass insulator of the fuse is carried parallel to but well above central section 13. Inside walls 19 of the legs 16 include recesses 18. Terminals 12 have outwardly extending portions or prongs 29, which cooperate with recesses 18 for snap engagement. On support base 11 at the raised bottom 11*a* of the channel 17, there is a centered hole 20 extending downwardly through the raised bottom 11*a*, seen in FIG. 3. Centered hole 20 is positioned to mate in male/female fashion with an extruded hole 21 punched outwardly and downwardly of the terminal 12 to prevent movement of the terminal 12 relative to the channel 17. Details of the snap engagement and conjugation of holes 20 and 21** are set forth below.

Each terminal 12 has a connector lug 22 extending outwardly, generally from the base of fuse receiving spring clip 23. The connector lug 22 can be shaped as a standard solder terminal or to form a spade for cooperation with a solderless terminal, can be transversely corrugated or can include a threaded fastener to secure a wire or connection terminal. The generally hairpin profile of the spring clip 23 (as shown in FIG. 3) has a clip base 24 in which punched extruded hole 21 is centered. Opposed upstanding spring fingers 25 extend upwardly from clip base 24. These fingers 25 cooperate to define a place to receive the cup shaped end caps of a tubular fuse 40, as seen in FIG. 1.

Each spring finger 25 is one of an opposed pair and is bent slightly toward the other of the pair to extend upwardly away from its base 24 at a slightly acute angle relative thereto to an inwardmost point 26 at a predetermined distance from the clip base 24, which is at least slightly more than one-half the diameter of the fuse end cap or the radius R of the fuse end cap, as seen in FIG. 3. The bent opposed spring fingers 25 extend upwardly and backwardly from the inwardmost points 26, away from each other to present and outwardly open fuse end cap receiving area 27, which is designed to initially engage the fuse end cap during insertion. Consequently, as fuse 40 is inserted its end caps cam the bent fuse receiving areas 27 of opposed spring fingers 25 outwardly. This permits the insertion of the fuse end caps past inwardmost points 26 which are thus spread and thereafter are biased toward one another for retaining the fuse end caps and holding them tightly against the clip base 24 of the terminal 12, whereby secure electrical connection is achieved.

Each fuse receiving spring clip 23, includes four of the previously described upstanding spring fingers 25, which from two sets of the opposed fuse contacting and holding pairs. Each of the opposed pairs has two spring fingers 25, which are on identical mirror image of each other. The pair nearest the end from which connector lug 22 extends from clip base 24 includes ears 28 which are bent inwardly. These inwardly bent ears 28 define the axial travel limit of fuse 40. Ears 28 are normal to the spring fingers 25 and are positioned just below the inwardmost point 26 of the spring fringers. Any axial contact between the ears and fuse 40 is made by the ears 28 touching the center horizontal diameter of a held fuse end cap, as seen in FIG. 3.

The mounting of terminal 12 into molded base 11 requires a recess 18 centered on an inside wall 19 of each leg 16. Recess 18 is set to receive and retain a prong 29 of terminal 12. Prong 29 is set between the upstanding spring fingers 25 on each side of the terminal clip base 24, is upwardly and outwardly obtusely angled. Prong 29 is fashioned of the same metal of fuse receiving spring clip 23 and as a part thereof, as seen in FIG. 3. Each extended prong 29 is disposed to snap into and engage the centered recess 18, which is molded into the inside wall 19 of each leg 16 of the support base 11. This snap fit for prong 29 helps maintain the fuse receiving spring clip 23 within the support base 11. As best seen in the cross sectional end view of FIG. 3, recess 18 is open downwardly through the bottom of support base 11, whereby the manufacture of the molded support base channel is greatly simplified. Recess 18 is elongated vertically and has an upper wall **18*a* provided to catch and retain the end of prong 29. The transverse width of recess 18 is suitable to receive prong 29 and may be tapered to facilitate the molding of the support base 11. The depth of the recess 18 is adequate to allow the prong 29 to fit therein and avoid interference with the held fuse and may be such as to add spring support and tension to spring fingers 25**.

The clip base 24 of the terminal clip 23 has a downwardly extending punched extruded hole 21, which is positioned to fit within a centered hole 20 in raised bottom **11*a* of the support base 11. Vertical movement of the fuse receiving spring clip is prevented by the complete snap engagement of prongs 29 into recesses 18 giving the prong end contact with upper wall 18*a* in recesses 18. Horizontal movement is controlled by extruded hole 21 which fits in centered hole 20 in channel 17. Upon insertion of fuse receiving spring clip 23 into open channel 17 formed by legs 16 and raised bottom 11*a*, prongs 29 first engage the upper inside walls 19 of the legs 16. A ramp 19*a* on each leg 16 extends outward of channel 17 from the upper wall 18*a* to the outer upper end of leg 16. Each prong 29 is gently bent inwardly by the camming action of ramp 19*a*, during sliding of prong 29 across the upper inside wall ramp 19*a*, prior to the snapping of prong 29 into position in recess 18. The length of prong 29 is such that its end just contacts the upper wall 18*a* when the clip base 24 is fully seated on raised bottom 11*a* of channel 17 and just after extruded hole 21 is fully seated in hole 20**.

The central section 13 of the rectangular support base 11, between upstanding legs 16, contains a mounting hole 15 for fuse holder 10. The vertical height of central section 13 is kept to a minimum consistent with adequate strength for fastener mounting to a chassis (not shown). Consequently, there is not only material savings, but also this construction permits ready access to the glass portion of the tubular fuse insulator for removal by means of tools or by hand. In particular, the position of clip base 24 of the fuse receiving spring clip 23 on the raised bottom area 11*a* is at a higher elevation then the elevation of central section 13 of the support base 11. This fuse support positioning parallel to and above the central section 13 facilitates access to the underside of the fuse glass insulator permitting the jaws of a fuse pulling tool to reach thereunder. Longitudinal ribs 11*b* are necessary along the elongated sides of central section 13 of the support base 11 to resist bending. The spacing of the ribs 11*b* at the extreme sides of central section 13 and efforts to keep the rib height to a minimum will allow the requisite access. Likewise, the ribs 11*b* will contribute longitudinal support for the support base 11 to resist twisting.

Extending laterally outward of central section 13 of support base 11 is a notched web 30 molded out of the same material as part of the support base 11. Notched web 30 is designed to longitudinally extend the entire elongated side length of rectangular base support 11, and to connect to other adjacent fuse support bases 11, retaining them in parallel side by side fashion. The parallel spaced rows of fuse holders held together by notched webs 30, are illustrated in FIGS. 1, 2 or 3. Specifically in FIG. 2, for example, each notch 31 is shown as a line extending the entire length of the long side of rectangular support base 11 to facilitate separation. There is at least one pair of parallel notches 31 extending throughout the length of web 30 and placed to define a line of weakness in the residual material 32 between the notches where at a severance or break may take place. The material of the polymeric support base 11 is relatively brittle, and therefore weak and easily breakable in thin sections, such as residual material 32 between notches 31. The remaining rough area 33, in FIG. 1, represents the place where such residual material 32 was broken. This rough area 33 was obtained by bending support base 11 across web 30 to induce bending and fracturing in residual material 32, as it is the most fragile part of the notched web 30. The relatively clean break at remaining rough area 33 is along the line of weakness defined by residual material 32. In a preferred embodiment, the notched web 30 is extended laterally to further separate the adjacent fuse holders, and two spaced apart pair of opposed notches 31 are used. Each pair is positioned next to its support base 11, whereby there is a body 34 of web 30 therebetween, as seen in FIG. 3. Consequently, fracture takes place along the two lines of weakness defined by the residual material 32, between each of the two spaced apart pair of opposite notches 31. Any number of the fuse holders 10 can be severed leaving a substantially clean break and body 34 of web 30 as scrap to be discarded. Body 34 has a generally diamond shaped cross section which results from the pair of opposed notches 31, which define each of the sides of web body 34.

The opposed spring fingers 25 never move horizontally apart enough to contact the inside walls 19 of legs 16, as they are relatively rigid compared to the spring fingers 25, and such contact would undesirably increase fuse insertion and removal force.

The clearance between the fuse receiving area 27 of the fuse spring fingers 25 and upper end of the inside wall is clearly apparent in FIG. 3. That clearance is adequate to prevent contact between the fingers 25 and inside wall 19, during insertion of the fuse.

It will be appreciated that the four spring fingers 25 on each terminal 12 cooperate with the clip base 24 of the fuse receiving spring clip 23 to provide five contact points with the metal fuse end cap, as seen in FIG. 3. As can be seen, the squat hairpin shape end profile of the fuse receiving spring clip 23 is such that the fuse will be securely held once placed completely within the clip 23. The description herein and the drawings explain and illustrate respectively, how the fuse is held downwardly in the fuse holder 10. The influence of gravity plays no part in the operation of the invention, as the spring force of the four spring fingers 25 is adequate to retain the fuse, even if the fuse holder 10 were inverted and exposed to shock, as would be the case in some applications. Consequently, the placement shown in the drawings is merely for convenience in understanding the description of the invention and is not essential to good electrical contact.

A particularly preferred embodiment has been shown and described. Skilled practitioners and artisans will no doubt appreciate that many modifications and revisions can be made without departing from the teachings of the disclosure. For example, but not limiting, different materials for molding the support base can include thermosetting polymers, phenolic compounds and other filled polymer combinations to provide superior heat, insulating, strength or molding properties, as require for specific applications. Likewise, the fuse receiving terminal 12 can be formed of spring brass unplated or plated with nickel or tin, beryllium copper unplated or plated with silver or any other suitable electrically conductive spring material. The claims which follow fairly protect the invention in its broadest context and are designed to include, not only material changes, but the type of changes which designers ordinarily make to distinguish the look of their product, but not the essential configuration or functional operation. In particular, the claims cover any of the following structures and their methods of use in a fuse holder; a five point contact system, an elongated fully longitudinal severance mechanism, a minimal vertical fuse removal force requirement resulting from a particular squat hairpin configuration of opposed spring fingers, a snap assembly between terminal clip and base where the snap prong is fashioned from the spring clip material, or the use of a low profile terminal spring clip with a raised fuse mounting above an elongated flat low central base to ease the grasping of an open fuse during removal of same.

Consistent with the disclosure and drawings herein, and in accordance with the embodiment described, the claims that follow set the boundaries of the invention. It should be understood and appreciated that the various features of the disclosed fuse holder and its method of use can properly be combined with one another or taken individually without departing from the overall scope of this invention.

What is claimed is:

1. A fuse holder for cylindrical bodied fuses having metal end caps including:

a support base having at least one generally flat elongated rectangular shaped section in a plane with upstanding legs normal to said plane each of said legs extending in the same direction outwardly therefrom, said legs being positioned along the elongated sides thereof at the ends of said flat section to form spaced apart end channels aligned with the longitudinal dimension of said elongated base for receiving a fuse, a bottom on said channels having an indentation therein said channel bottom being disposed parallel to and above said plane of said flat section to support a fuse at its ends with its center apart from said flat section, a recess in each of said legs positioned in each of the inside walls thereof, terminal means each having a connector lugs and fuse receiving and contacting spring clips, wherein said lugs extend from said terminal means for electrical connection to a circuit and said clips being generally of a squat U shape in cross sectional end profile and where the bottom curve of said U being the base of said clip, outwardly projection resilient retaining means on said spring clips for engagement with said recesses in said legs for securing said terminal means to said support base, said flexible retaining means extending outwardly from said clip base yet being capable of flexure relative thereto inwardly of said end channels during insertion of said terminal means into said channels, prior to full engagement with said recesses, and rigid retaining means extending outwardly from said base of said clip for conjugation with said bottom indentation of said channel to more rigidly hold said terminal means on said support base.

2. The fuse holder of claim 1, wherein said rigid retaining means are extruded punched holes to conjugate with said channel bottom openings to prevent movement of said terminal means relative to said support base.

3. The fuse holder of claim 1, wherein each of said recesses extends along said leg from the bottom thereof a predetermined distance to about the upper middle thereof and each terminates in an upper wall normal to said inside wall of said leg.

4. The fuse holder of claim 3, wherein said inside wall above each said recess has an outwardly angled ramp extending from said upper wall away from said channel and to the top of said leg.

5. The fuse holder of claim 4, wherein said flexible retaining means are prongs fashioned from said terminals clips extending obtusely from said base and which during insertion of said terminal means into said channel first engage said ramps and are flexed thereby inwardly to permit sliding movement of said terminal means fully into said channels where upon said prongs snap outwardly to seat within said recesses.

6. The fuse holder of claim 5, wherein each said prong is engaged with said upper wall of each said recess to prevent outward movement of said terminal means relative to said channel when said clip base is fully seated against said channel bottom and each said extruded hole is completely conjugated with each said opening.

7. A method of assembling a fuse terminal clip into a channel of a fuse support base, wherein said terminal clip includes a prong member fashioned therefrom to resiliently engage a recess within a side wall of said channel of said support base and another part adapted to conjugate rigidly with a portion of said channel including the following steps:

positioning said terminal clip in relative alignment with an open upwardly extending channel on said support base for assembly of said terminal into said channel, sliding said terminal into said channel from above while maintaining the alignment, flexing said prong member across a top portion of said side wall of said channel to allow further sliding of said terminal into said channel, conjugating said rigid terminal part with said channel portion, and seating said terminal in said channel upon resilient snap engagement of said prong member into said recess in said side wall and complete conjugation of said part in said portion.

8. The method of claim 7, wherein said method includes flexing and snap engagement of one member for each of the walls of said channel.

9. The method of claim 8, wherein said method includes assembling a fuse terminal clip at each end of said support base.

10. A fuse holder for tubular body fuses having metal end caps wherein the base of the holder is of an insulative substance which supports at least a pair of terminals in spaced apart alignment for contact with the metal end caps of the fuse for holding it relative to the support base comprising:

elongated support base adapted to receive and position terminals for support of said tubular body fuse for contact with and retention of said fuse, a terminal having a connection lug at one end and a fuse receiving clip at the other end including outwardly projecting resilient retaining means releasibly securing the terminal to the base, said clip being formed of a resilient conductive material for permitting connection to a circuit at said lug end and contact with and retention of a metal end cap of said fuse in said receiving clip, a base on said clip being the substantially flat bottom part of a squat U shape when said clip is viewed in end profile, at least two pairs of opposed spring fingers on said clip where each pair first extend in the same direction away from said base and slightly toward each other at an acute angle to said base from opposite sides of said clip base to define a space to receive said end cap of said fuse and said pair of opposed fingers thereafter further extending from said base and from each other by being bent away from each other to provide an open area to initially receive said fuse end cap, and inwardmost points positioned at said bend between the inward and bent away from portions of said pair of opposed fingers wherein said points are above said base a distance slightly greater than the radius of said fuse end cap.

11. The fuse holder of claim 10, wherein there are four said inwardmost points on said two pair of opposed spring fingers which cooperate with said base to form five points of contact with said fuse end cap.

12. The fuse holder of claim 11, wherein the fuse radius is 0.125 inches and each said inwardmost point of said clip is slightly higher than the 0.125 inches above said base of said clip.

13. The fuse holder of claim 10, wherein said opposed pair of spring fingers nearest said lug includes inwardly turned ears extending toward each other and normal to said fingers for limiting axial movement of said fuse.

14. The fuse holder of claim 13, wherein said ears extend from said pair of opposed fingers below said inwardmost points to contact the middle of the fuse end cap.

15. The fuse holder of claim 10, wherein said lug is configured to receive a solderless terminal connector for circuit connection.

16. A fuse holder for retaining an elongated cylindrical bodied fuse on an insulative base in terminals mounted to said base for connection of said fuse into a circuit, said fuse holder comprising:

a plurality of fuse connecting terminals, each including outwardly projecting resilient retaining means;

an elongated terminal base means, a plurality of generally rectangular terminal support bases each having surfaces receiving said retaining means for securing said fuse connecting terminals in opposed facing alignment within the bases, interconnecting webs extending along at least one longitudinal side of one of said rectangular support bases and laterally therefrom to the longitudinal side of another of said rectangular support bases and attached thereto, and a thinned cross section running the longitudinal length of said web to define a lone of weakness in said web for locating, enhancing and facilitating the severance of said web and thereby the separation of at least one of said bases from said elongated terminal base means.

17. The fuse holder of claim 17, wherein said interconnecting webs are attached to both of said adjacent sides throughout their entire longitudinal length and carry said rectangular support bases in parallel side by side relation with said terminal carrying surfaces spaced laterally from one another a predetermined distance.

18. The fuse holder of claim 18, wherein said thinned cross section is located at said side of one of said rectangular support bases to provide a line of clean severance between said web and said side leaving substantially no portion of said web remaining attached to said one side.

19. The fuse holder of claim 18, wherein said thinned cross section is defined by at least a notched line running the longitudinal length of said web.

20. The fuse holder of claim 18, wherein said thinned cross section is defined by at least a pair of opposed notches positioned on opposite sides of said web across the thickness thereof to provide a line of weakness running the longitudinal length of said web where the area of weakness is the residual material remaining between said pair of notches.

21. The fuse holder of claim 21, wherein there are two said pair of opposed notches each carried in said web near said rectangular support bases to define a line of weakness immediately adjacent said side of each said base for clean severance therefrom on each side of said web leaving said rectangular bases apart from one another and apart from said web.

22. The fuse holder of claim 22, wherein said elongated terminal base means and said interconnecting web are molded as a unit of polymeric insulative material.

23. The fuse holder of claim 22, wherein said interconnecting web is generally diamond shaped in lateral cross section.

24. A fuse holder system for a fuse having a tubular body and including a pair of conductive end caps including:

an insulative support base with a generally rectangular elongated portion having a flat thin central section and a pair of raised ends, pairs of upstanding legs located along the longitudinal sides of said base and extending from said raised ends to define channels thereat with said channels being aligned along the longer dimension of said rectangle, a pair of terminals configured to be mounted within said channels on said raised end in opposed alignment for holding a fuse therebetween and in spaced parallel relation to said flat central section thereby permitting access to the fuse body for removal of the fuse from the terminals, and each of said terminals including outwardly projecting resilient retaining means engaging the legs of its respective channel to releasibly secure the terminal to the base.

25. The fuse holder system of claim 24, wherein said support base is one of several connected by laterally extending webs to carry said support bases in parallel spaced relation to one another.

26. The fuse holder system of claim 25, wherein said support is molded of a polymeric substance which has a high dielectric value.

27. The fuse holder system of claim 24, wherein said support base includes a centered mounting hole with a recess to receive a fastener therethrough and a fastener head therein.

* * * * *